US007654345B1

(12) United States Patent
Keck

(10) Patent No.: US 7,654,345 B1
(45) **Date of Patent: *Feb. 2, 2010**

(54) WEAR RESISTANT SUB ASSEMBLY

(76) Inventor: Clark Barton Keck, 2339 1/2 A Rattle Snake Ct., Grand Junction, CO (US) 81503

( * ) Notice: Subject to any disclaimer, the term of this patent is extended or adjusted under 35 U.S.C. 154(b) by 0 days.

This patent is subject to a terminal disclaimer.

(21) Appl. No.: 12/051,767

(22) Filed: Mar. 19, 2008

(51) Int. Cl.
*E21B 17/10* (2006.01)

(52) U.S. Cl. ..... 175/325.5; 166/241.6

(58) Field of Classification Search ..... 166/242.4, 166/242.1, 241.6, 241.7; 175/325.1, 325.3, 175/325.4, 325.5, 325.7
See application file for complete search history.

(56) References Cited

U.S. PATENT DOCUMENTS 3,054,647 A * 9/1962 Von Rosenberg ..... 175/325.4
3,480,094 A * 11/1969 Morris ..... 175/325.5
3,667,817 A * 6/1972 Kellner ..... 175/325.5
4,296,973 A * 10/1981 Hartwell ..... 175/325.4
5,261,498 A * 11/1993 Steinkamp et al. ..... 175/325.3
5,833,018 A * 11/1998 von Gynz-Rekowski . 175/325.3
7,520,344 B1 * 4/2009 Keck ..... 175/325.5

* cited by examiner

*Primary Examiner*—Jennifer H Gay
*Assistant Examiner*—David Andrews
(74) *Attorney, Agent, or Firm*—Buskop Law Group, PC; Wendy Buskop

(57) ABSTRACT

A wear resistant sub assembly with a sleeve with a sleeve outer diameter larger than the body outer diameter, a plurality of offset indentations formed on the outer side of the sleeve formed in rows of four to eight offset indentations along a diagonal orientation to a sleeve axis; a plurality of a metal carbide inserts providing an interference fit into each offset indentation thereby forming a wear resistant sleeve; a sealing means disposed between the sleeve and the body and at least two spring locking apparatus engaging locking indentations on the body.

12 Claims, 4 Drawing Sheets

WEAR RESISTANT SUB ASSEMBLY

FIELD

The present embodiments relate to a wear resistant sub assembly with a removable, interchangeable, replaceable, wear sleeve for use on drill pipe and bottom hole assemblies using removable, replaceable metal carbide inserts on the sleeve.

BACKGROUND

A need exists for a wear resistant sub assembly with an easily replaceable sleeve that saves wear and tear on drilling tubulars.

A need exists for a wear resistant sub assembly that is easy to repair in the field, easy to remove and install wear resistant portions, and is highly reliable during use.

The present embodiments meet these needs.

BRIEF DESCRIPTION OF THE DRAWINGS

The detailed description will be better understood in conjunction with the accompanying drawings as follows.

Figure 1:
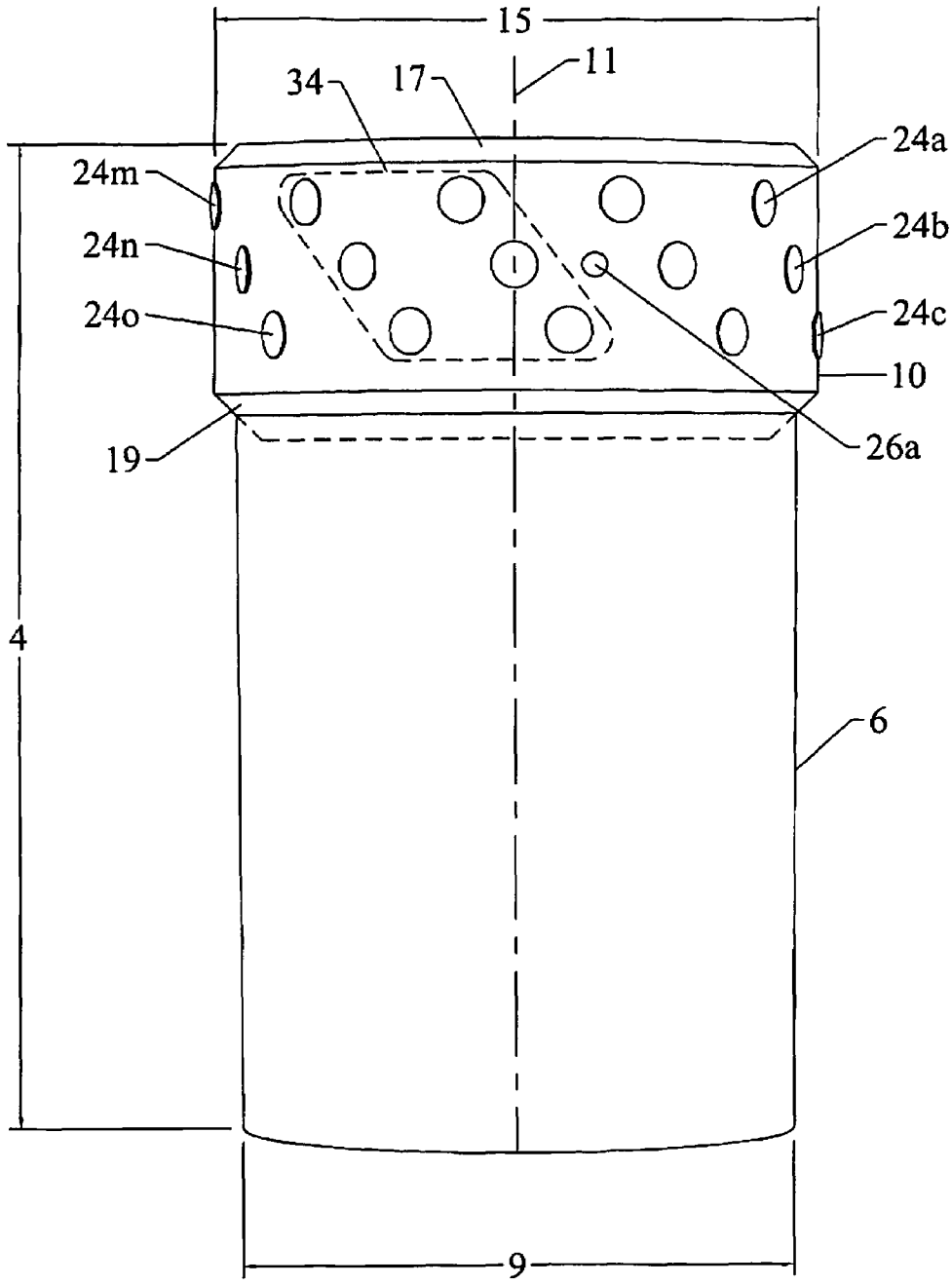
FIG. 1 depicts a side view of an embodiment of the wear resistant sub assembly.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The invention relates to a wear resistant sub assembly that is easily reparable using an easily replaceable sleeve. The sub assembly is for use inside a borehole of a well such as a natural gas well, and wells created and used for mining natural resources, an oil well or even a water well.

The sleeve portion of the sub assembly can have a length ranging from about 2 inches to inches about 20 inches, preferably 2.66 inches in length. The sleeve can have a wall thickness from about 0.4 inches to about 1.5 inches, and an inner diameter from about 4.5 inches to about 10 inches, preferably between about 6 inches and 7 inches.

The sleeve of the sub assembly can be fitted to the body of the sub using a sealing means such as is a silicon gasket disposed into a seating groove that is milled into the body of the sub or corresponding tubular. The seating groove receives a bottom portion of the sleeve, and the sealing means seats the sleeve securely therein.

The sleeve has a top portion and opposite the top portion is a sleeve bottom beveled edge that can be tapered to a point to fit in the seating groove which is also termed "a dove tail" of the body. Alternatively, the sleeve bottom beveled edge is tapered to a plane face and received in the seating groove.

The sleeve can be longer or shorter than the above ranges, if use merits. The sleeve can have a larger wall thickness up to about 2 inches for use in very heavy drilling operations.

The sleeve has an inner side which slips over the body of a sub, so that the two form the wear protected sub assembly. The inner side supports at least one, but more likely two spring locking apparatus that engage a locking portion milled into the body. The locking portion can be either locking indentations or a locking groove milled all the way around the perimeter of the tubular or body of the sub.

The sleeve has an outer side slightly larger than outer diameter of the body of the sub which assists in supporting the wear pad at a distance from the outer diameter of the body of the sub.

The sleeve separates the body of the sub assembly from the walls of the well bore or from drilling muds or other fluids with or without particulate that flow in the well.

The sleeve is formed with a plurality of offset indentations that are oriented on a diagonal pattern, tangent to the axis of the sleeve. More specifically, the offset indentations are oriented at an angle from about 7.5 degrees to about 45 degrees from the sleeve axis.

The offset indentations can be arranged in a linear fashion or a curvilinear fashion along the outer side.

In an embodiment, each offset indentation is contemplated to be generally circular in shape. Other shapes may be considered as usable herein such as elliptical shapes.

In an embodiment, each offset indentation on the sleeve can be formed with a diameter identical to the diameters of the other offset indentations.

Each of the offset indentations is oriented a distance away from an adjacent indentation at a distance that is equivalent to about ½ the diameter of the adjacent indentation.

The offset indentations can have diameters that range from about 3/20 inches to about ¾ inches. However, in another embodiment, some diameters for offset indentations on a sleeve can have a diameter different from diameter of other offset indentations.

For example, a sleeve about 6 inches in width and 2.66 inches long is contemplated to have about 52 offset indentations formed in the outer side of the sleeve. Each offset indentation is contemplated to be round. It is contemplated that 6 rows of offset indentations are used on the outer side, although from about 4 to about 8 rows of offset indentations could be used on a sleeve. The number of rows can vary depending on the size and intended use of the sleeve.

In this example, it is contemplated that the offset indentations are oriented diagonally, at a 45 degree angle, in rows of six offset indentations around the six inch sleeve. The diameter of the sleeve is contemplated to be ½ inch. The rows of offset indentations are formed at a distance from adjacent offset indentations equivalent to ½ the diameter of an offset indentation.

For larger wear resistant casing assemblies, there may be more rows than six, or there may be larger diameter offset indentations.

Offset indentations preferably have consistent depths for each sleeve. Depending on the size of the sleeve, the offset indentations can range in depth from about 3/20 of an inch to about ¾ of an inch.

The offset indentations can have a preferred diameter ranging from about ¼ inch to about 1 inch.

A metal carbide insert is pressed into each offset indentation forming an interference fit and creating the wear resistant surface of the sub assembly.

Each metal carbide insert can have at least one knurl for providing a more secure interference fit into an offset indentation.

A knurl is a ridge along the body of the metal carbide insert. Usable knurls are thought to have a width of about 1/16 inches.

More than 1 knurl is contemplated as usable on each metal carbide insert. It is contemplated that one metal carbide insert, such as a tungsten carbide insert is used per offset indentation.

The formed wear resistant sleeve, with the plurality of metal carbide inserts is not a complete coating on the sleeve surface. This "bumpy surface" absorbs a substantial portion of the friction from the walls of the borehole preventing degradation of the sub assembly caused by friction while drilling equipment turns without having to completely coat the sub body or tubular. This saves cost of materials.

At least one spring locking apparatus, and up to three such locking apparatus, are contemplated for use to hold the sleeve to the body forming the wear resistant sub assembly. These can be conventional spring and ball locking apparatus from ordinary supply stores.

It is contemplated that the body may have at least one, and possibly many, such as 4 or 6 locking indentations formed in the body such that each locking indentation corresponds to one of the spring locking apparatus.

These spring locking apparatus can be purchased from Granger or other industrial supply houses.

A feature of the invention is that individual metal carbide inserts can be easily replaced if they fly off the sleeve during drilling.

A feature of the invention is that groups of metal carbide inserts can be easily replaced in the case of uneven wear.

A feature of the invention is that as all the metal carbide inserts wear out, all can be replaced on the drill floor without welding or the need for special training by a drilling hand or roughneck.

A feature of the invention is that the entire wear resistant sleeve portion of the wear resistant sub assembly can be replaced easily and quickly by the drilling hand for the sub assembly.

The metal carbide inserts are contemplated to be made from tough metals. For example, the metal carbide insert can be a tungsten carbide insert with about 8 percent to 12 percent cobalt. The metal carbide inserts can be made of numerous alloys that provide substantial wear properties.

A feature of this device is that the wear resistant sub assembly can have a first sleeve with a set of inserts could be used for certain types of friction, and then that first sleeve can be replaced with a second sleeve with a different set of inserts depending on the level of protection desired for the sub assembly.

This wear resistant sub assembly can be used longer in the field, without need to return to a manufacturing site, or without needing to replace the entire sub assembly during use. This is a significant cost saving feature of the invention.

The metal carbide inserts are contemplated to be cylindrical in shape, or domed or "capped" with a half circle. If the metal inserts are domed, it is contemplated that the dome can rise about 1/10 of an inch to about 1/4 of an inch above the sleeve forming a "button" or "cap" on the sleeve. By having enough of these "buttons" or "caps" and each cap being thick enough, a wear resistant sub assembly is formed. The caps can be square.

Still another benefit of the invention, the metal carbide inserts do not need to be precisely fit into the offset indentations forming the wear resistant sub. This invention enables less skilled workers to make and use the invention which is a significant cost saving to known sub assemblies that required skilled workers to fix and replace parts, skilled with welding skills, and other metallurgical skills.

The embodiment of the invention using knurls on the metal inserts gets around a need for fine machined tolerances to create the interference fits. The metal carbide inserts can be simply pushed into the offset indentations in the sleeve. This means less skilled workers are needed to make the offset indentations.

When the metal carbide insert is pressed in, the carbide which is harder than the softer sleeve metal, slightly deforms the sleeve metal. The metal carbide insert is then locked into place without need for an adhesive, a fastener or welding.

A benefit of the invention is in using the diagonal "offset" pattern for the offset indentations with metal carbide inserts. This pattern saves money and labor time.

This diagonal pattern to the sleeve axis requires fewer metal carbide inserts than horizontal patterns, which again lowers the cost of manufacture of this device while still providing a great wear resistant sub assembly.

FIG. 1 shows an embodiment of a sub assembly (4) with a body (6) covered with a sleeve (10) held to the body using one of the pluralities of spring locking apparatus (26*a*). The sleeve (10) is shown having a sleeve axis (11). Two or three spring locking apparatus are contemplated for use to engage a locking portion, which in this embodiment is contemplated to be locking indentations which can not be seen in this embodiment, on the body (6).

Figure 2:
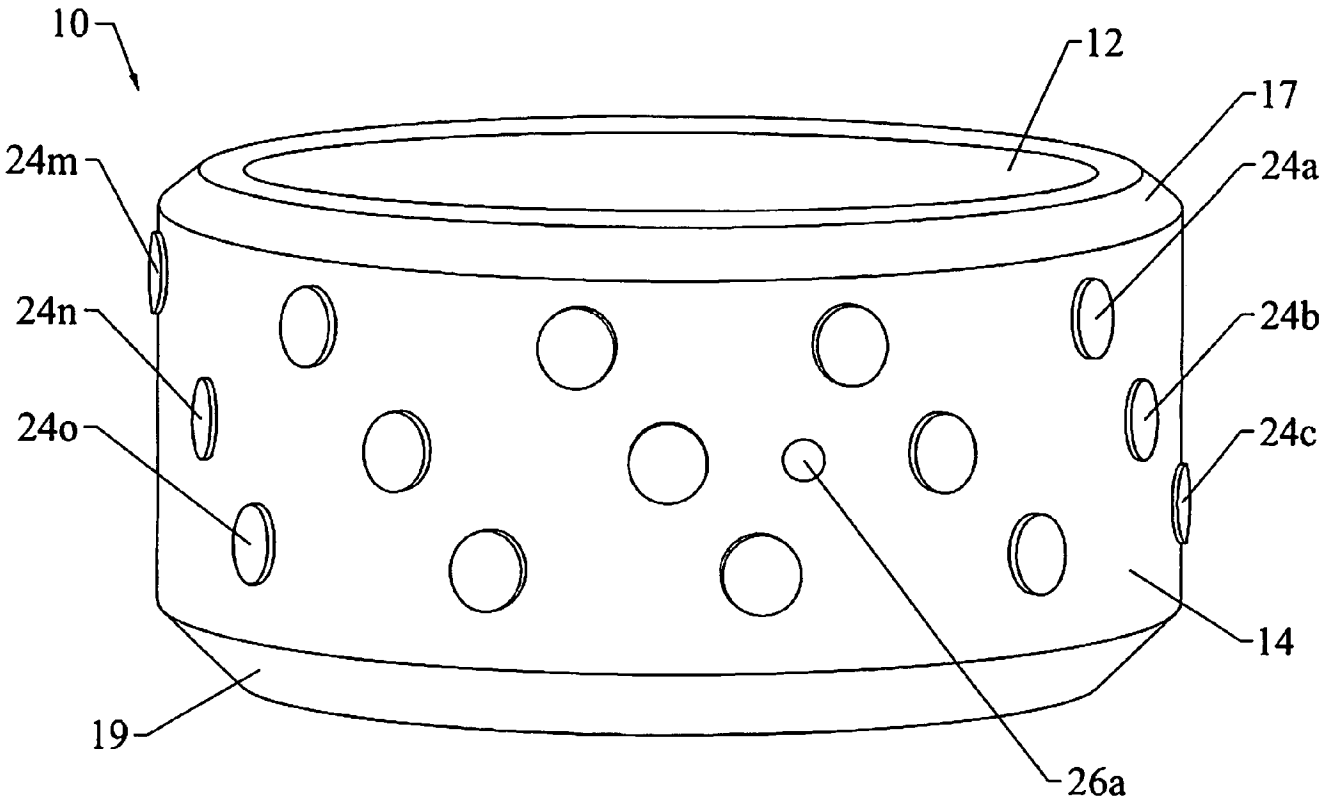
FIG. 2 depicts a detail of the sleeve.

This Figure shows the sleeve (10) having an outer side (14). FIG. 2, the perspective view of the sleeve (10), shows the sleeve (10) having an inner side (12) and the outer side (14).

The sleeve (10) securely engages the body (6) but in a removable manner. This removable locking engagement permits the outer side of the sleeve to receive a substantial portion of frictional wear from drilling of a borehole without damage to the body while being replaceable. The sleeve acts as a "casing saver" for the wear resistant sub assembly. The body can be made of a manganese alloy.

The sleeve (10) is shown having a plurality of tungsten carbide inserts (24*a-o*) inserted in offset indentations (not shown in this Figure but shown in FIG. 2). Each offset indentations can have a diameter ranging from about 3/20 of an inch to about 3/4 of an inch.

The offset indentations engage the carbide metal inserts. In this embodiment, the offset indentations have identical diameters.

It is contemplated that the sleeve also has a sleeve outer diameter (15) which is slightly larger than the body outer diameter (9) by 1/4 inch and up to 4 inches.

The sleeve (10) is also shown having a sleeve top square cut edge (17) opposite a sleeve bottom beveled edge (19) that fits within a seating groove (27) on the body. The seating groove is shown in FIG. 3.

Figure 3:
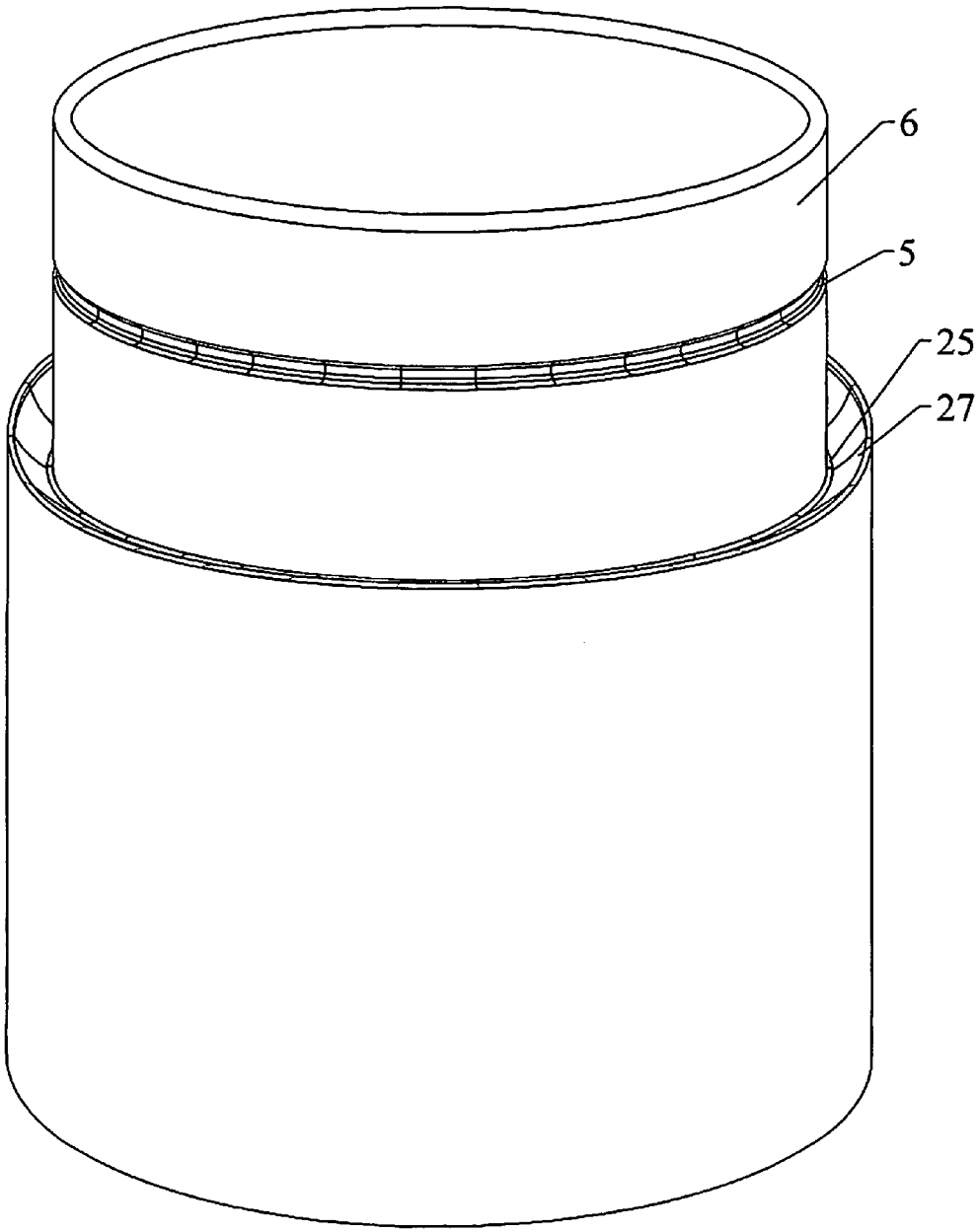
FIG. 3 shows a perspective view of the body of the sub assembly without the sleeve.

A sealing means (25), shown in FIG. 3, such a silicon gasket, can fit into the seating groove (27) on the body (6) and allow the sleeve bottom beveled edge to fit with a dove tail of the body to have a sealing engagement with the body (6).

FIG. 2 shows a detail of the sleeve (10) with the tungsten carbide inserts (24*a,b,c*, through *o*) installed in a "X" pattern using linear rows diagonal to the sleeve axis namely, at a 45 degree angle. The outer side (14) and the inner side (12) of the sleeve (10) are also shown.

In this embodiment of FIG. 2, it is contemplated that each metal carbide insert is an insert that has a total weight of about 8 weight percent to about 12 weight percent cobalt over a tungsten carbide.

FIG. 3 shows a side view of a body (6) with a locking portion (5) that is shown to be a locking groove in this embodiment for engaging the spring locking apparatus of the sleeve (10).

FIG. 3 also shows the seating groove (27) into which the sleeve (10) can slide. The locking groove is milled into the body (6) and in that seating groove (27) is located a sealing means (25), which can be a gasket or another removable sealing material, such as a silicon gasket.

Figure 4:
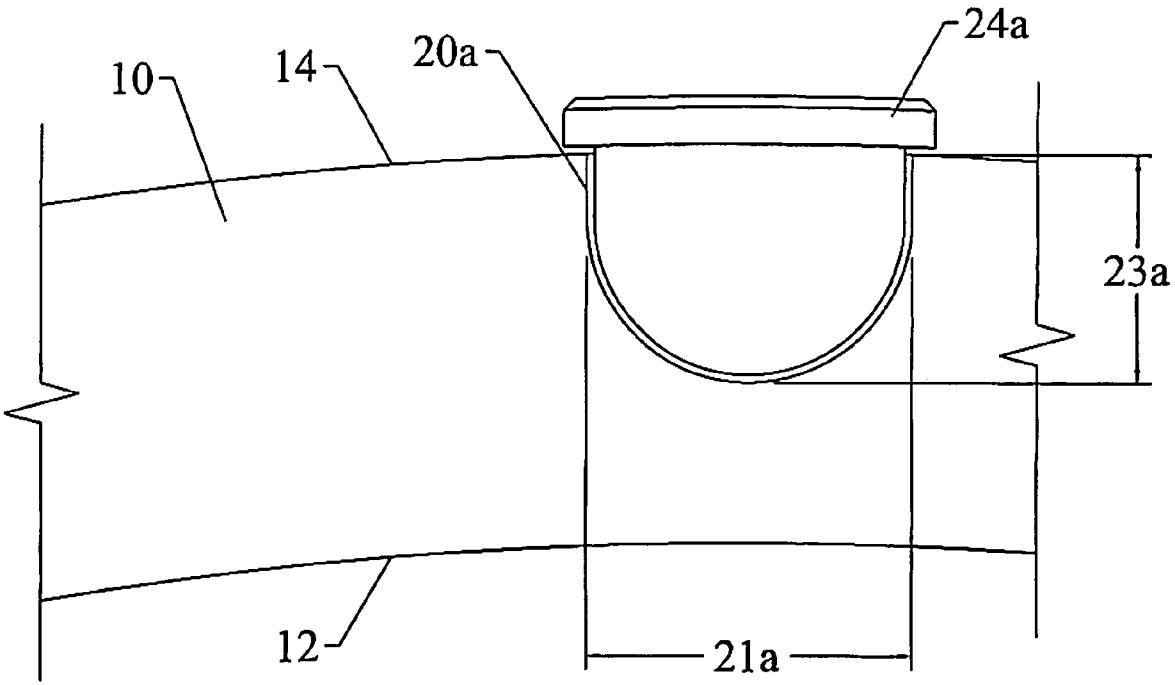
FIG. 4 depicts a cross sectional view of a sleeve with a metal carbide insert.

FIG. 4 shows a cut away view of a metal carbide insert engaging the sleeve. The tungsten carbide insert (24*a*) is part of the wear resistant sleeve (34) of the outer side (14) of the sleeve. The metal carbide insert (24*a*) has a ridged surface (a knurl) providing a tight interference fit with the offset indentation (20*a*). The offset indentation (20*a*) is depicted with an offset indentation diameter (21*a*) and an offset indentation depth (23*a*).

The tungsten carbide insert has a cap portion that extends above the offset indentation which in this view is shown as a domed square cap. The cap can also be a flat square, domed circle, flat or domed rectangle or another flat or domed shape.

The metal inserts have a cylindrical metal body and with the "cap" form a "T" shape. The cap can rise about 1/10 inch to about 1/4 inch above the outer side of the sleeve.

While these embodiments have been described with emphasis on the embodiments, it should be understood that within the scope of the appended claims, the embodiments might be practiced other than as specifically described herein.

What is claimed is:

1. A wear resistant sub assembly for use with well boring equipment, comprising:

a body with a body outer diameter, wherein the body comprises an end formed in the body, a locking portion and a seating groove;

a sealing means disposed in the seating groove;

a sleeve having a sleeve axis, an inner side and an outer side and wherein the sleeve outer diameter is larger than the body outer diameter, and wherein the sleeve slides into the seating groove with the sealing means;

at least two spring locking apparatus disposed on the inner side removably engaging the locking portion of the body;

a plurality of offset indentations formed on the outer side of the sleeve in rows of four to eight offset indentations along an angle sloping from about 7.5 degrees to about 45 degrees from the sleeve axis; and a metal carbide insert for each offset indentation, wherein the metal carbide inserts are interference fit into one of the offset indentations thereby forming a wear resistant sub assembly.

2. The wear resistant sub assembly of claim 1, wherein each of the offset indentations is oriented a distance away from an adjacent offset indentation at a distance equivalent to about 1/2 the diameter of the adjacent offset indentation.

3. The wear resistant sub assembly of claim 1, wherein the offset indentations have a diameter ranging from about 3/20 of an inch to about 3/4 of an inch.

4. The wear resistant sub assembly of claim 1, wherein the metal carbide insert is a tungsten carbide insert.

5. The wear resistant sub assembly of claim 1, wherein the body comprises a manganese alloy.

6. The wear resistant sub assembly of claim 1, wherein the metal carbide inserts are cylindrical, or domed in shape.

7. The wear resistant sub assembly of claim 1, wherein the sleeve has an inner diameter from about 4.5 inches to about 10 inches.

8. The wear resistant sub assembly of claim 1, wherein the sealing means is a silicon gasket.

9. The wear resistant sub assembly of claim 1, wherein the sleeve has a sleeve bottom beveled edge that is tapered to a point.

10. The wear resistant sub assembly of claim 9, wherein the sleeve bottom beveled edge is tapered to a plane face.

11. The wear resistant sub assembly of claim 1, wherein the offset indentations have identical diameters.

12. The wear resistant sub assembly of claim 1, wherein each metal insert comprises a total weight of about 8 weight percent to about 12 weight percent cobalt over a tungsten carbide.

* * * * *